US005430627A

United States Patent [19]

Nagano

[11] Patent Number: 5,430,627

[45] Date of Patent: Jul. 4, 1995

[54] STEP LIGHTING APPARATUS

[75] Inventor: Thomas T. Nagano, Cerritos, Calif.

[73] Assignee: Tivoli Lighting, Inc., Santa Ana, Calif.

[21] Appl. No.: 78,627

[22] Filed: Jun. 16, 1993

[51] Int. Cl.[6] ..... F21S 1/02

[52] U.S. Cl. ..... 362/146; 362/224; 362/240

[58] Field of Search ..... 362/81, 146, 240, 224, 362/125, 225

[56] References Cited

U.S. PATENT DOCUMENTS

| | | | |
|---|---|---|---|
| D. 311,588 | 10/1990 | Nagano | D26/24 |
| D. 312,135 | 11/1990 | Nagano | D26/2 |
| 3,885,144 | 5/1975 | Lewis et al. | 362/146 X |
| 4,271,458 | 6/1981 | George, Jr. | 362/236 |
| 4,544,996 | 10/1985 | George | 362/238 |
| 4,612,606 | 9/1986 | Roberts | 362/146 |
| 4,625,266 | 11/1986 | Winter | 362/146 |
| 4,665,470 | 5/1987 | George, Jr. | 362/236 |
| 5,045,981 | 9/1991 | Nagano | 362/219 |
| 5,222,799 | 6/1993 | Sears et al. | 362/146 |

OTHER PUBLICATIONS

Tivoli "Escort Lights" brochure, 1989, Tivoli Industries, Inc.

Tivoli "Guidelighht Extrusions" brochure, 1992, Tivoli Lighting, Inc.

*Primary Examiner*—Stephen F. Husar

*Attorney, Agent, or Firm*—Price, Gess & Ubell

[57] ABSTRACT

A light fixture housing extrusion that includes a horizontal step plate intersecting a vertical riser plate and having first and second channels for mounting string light fixtures beneath removable translucent covers, the channels including grooved wall structures to facilitate securing of the covers and either a pair of tangs or a pair of interior recessed walls for receiving and retaining a spring-biased wedge clip lamp carriage. Other features include an improved wiring scheme with individually-fused light strings, a diode for dimming the light output of selected strings, and a riser lens cover having a unitarily-extruded extended shield which prevents viewing the direct glare from elevated lighting fixtures.

19 Claims, 4 Drawing Sheets

STEP LIGHTING APPARATUS

BACKGROUND OF THE INVENTION

1. Field of the Invention

The present invention relates to lighting fixtures and, more specifically, to extruded lighting fixtures for illuminating steps.

2. Description of Related Art

Low-voltage string-lighting systems have been used extensively for decorating and illuminating applications in both private homes and commercial establishments. Low-voltage string-lighting systems are often used to illuminate and decorate walls, floors, ceilings, and staircases of restaurants, nightclubs, hotels, and movie theaters.

A typical low-voltage string-lighting system, such as those used for aisle lighting, includes a power line having multiple miniature light fixtures attached thereto (hereinafter a "light string"), an external housing made of a durable material such as vinyl or aluminum, and an external covering which is translucent and generally fits within the housing. The external housing is typically manufactured by an extrusion process and is commonly referred to in the lighting industry as an extrusion.

A single light string in a common string-lighting system may include dozens of individual light bulbs. Because string-lighting systems include so many light bulbs, it is common for some of the bulbs to burn out. Thus, it is frequently necessary to replace one or more light bulbs on a light string. It may also be desirable to change light bulbs for decorative reasons, for example, to change the bulbs to a different color. It is therefore desirable to have a decorative string-lighting system which has easily-replaceable light bulbs.

Additionally, shorts in individual light bulbs may arise, for example, in the course of changing bulbs or from various other causes. Conventionally, such a short blows a fuse in a main transformer, causing all light bulbs illuminating, for example, an entire staircase, to go out.

While advances have been made in fixtures providing replaceable light bulbs, the fixtures themselves are typically nonremovably fixed in place or otherwise difficult to access. A need therefore exists in the art for improved lighting structures and circuitry featuring optimally-disposed lighting channels for providing both illumination of step paths and visibility from distances, as well as easily-removable fixtures and replaceable lights. There is also a need for controlling the intensity of lighting, for example, to dim the lighting or to prevent viewing the direct glare visible when riser lighting is provided above eye level.

SUMMARY OF THE INVENTION

The present invention is an improved step lighting apparatus configured to facilitate installation on the edge or "nosing" of a step. The apparatus includes a plurality of channels, each of which holds a string of low-voltage light fixtures. The channels include grooves and tangs to hold translucent light covers and to removably secure the light fixtures within the channel.

Features provided according to the preferred embodiments include a configuration structured to securely fix the apparatus on the corner of a step; a wedge clip lamp carriage which facilitates releasably securing the light fixtures in the channels of the apparatus; and a channel structure which permits translucent external covers of different sizes to be used.

Dual-channel units according to a preferred embodiment permit lights to be installed to light the step tread or the step riser or both, providing adaptability of the units to various applications. An improved wiring scheme is disclosed which provides individually-fused light strings and means for dimming the light output of selected strings. Another advantageous feature usable with various embodiments of the invention is a riser lens cover having a unitarily-extruded extended shield which prevents viewing the direct glare from elevated lighting units.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
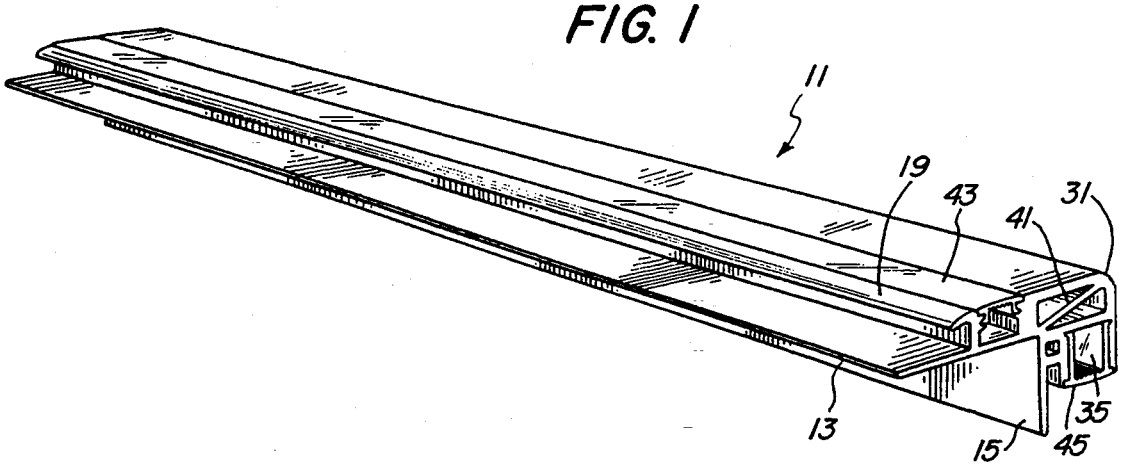
FIG. 1 is a top rear perspective of a step lighting apparatus according to the preferred embodiment.
Figure 2:
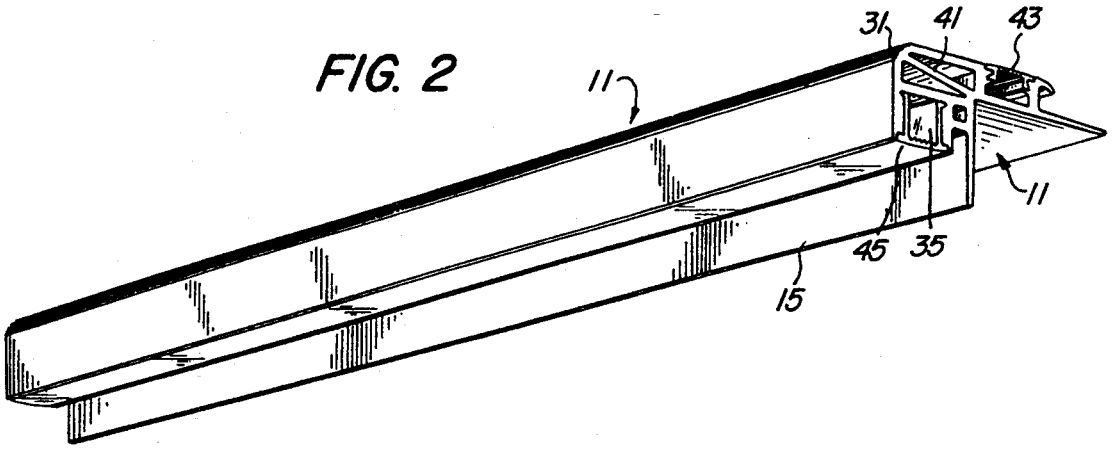
FIG. 2 is a bottom front perspective of the lighting apparatus of FIG. 1.
Figure 3:
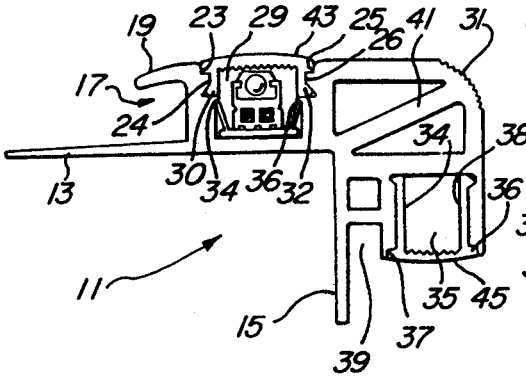
FIG. 3 is a cross-sectional view of one end of the lighting apparatus of FIG. 1.
Figure 4:
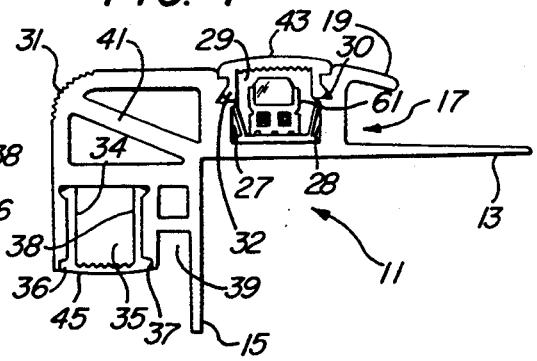
FIG. 4 is a cross-sectional view of the lighting apparatus of FIG. 1 showing the end opposite that shown in FIG. 3.
Figure 5:
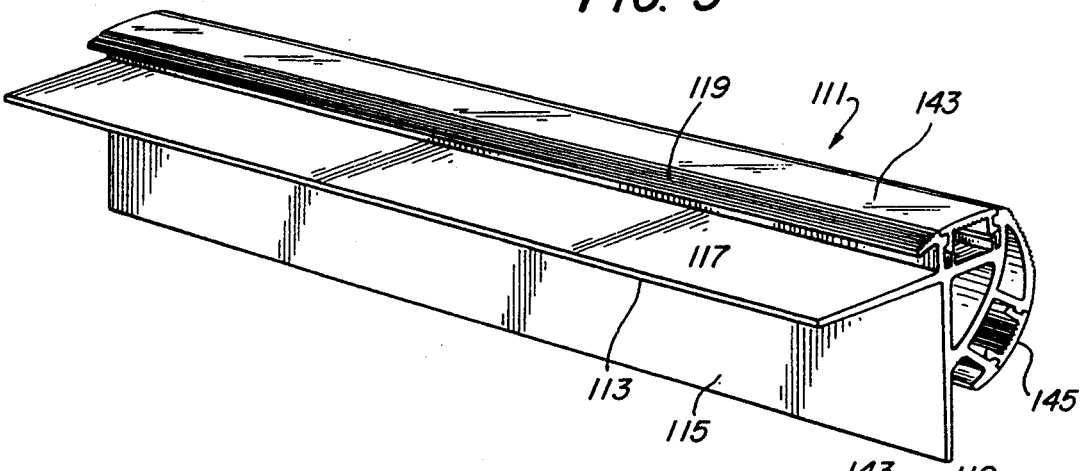
FIG. 5 is a top rear perspective of a second embodiment of the lighting apparatus according to the preferred embodiment.
Figure 6:
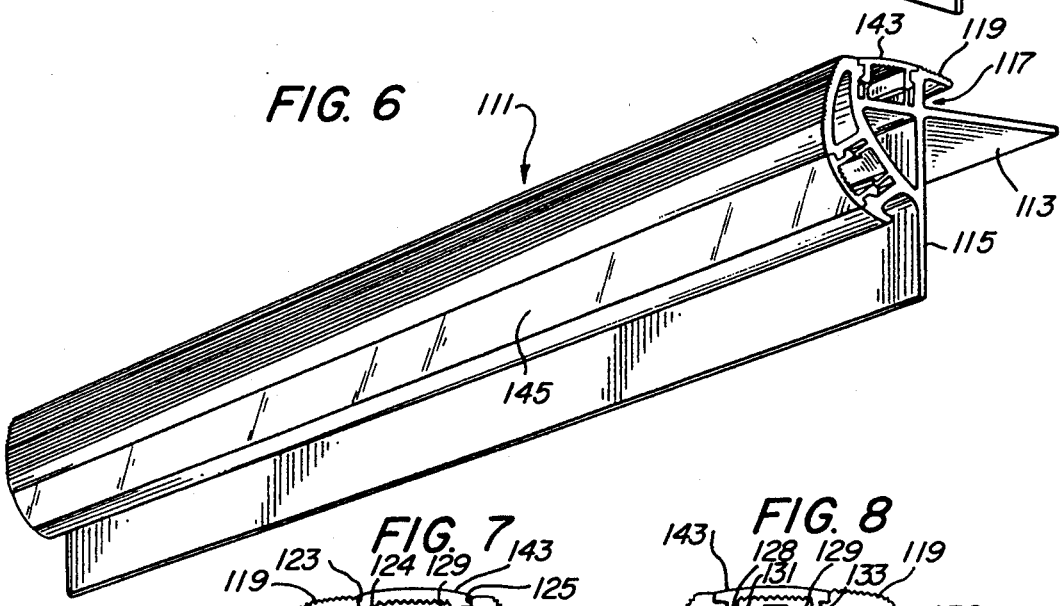
FIG. 6 is a bottom front perspective of the lighting apparatus of FIG. 5.
Figure 7:
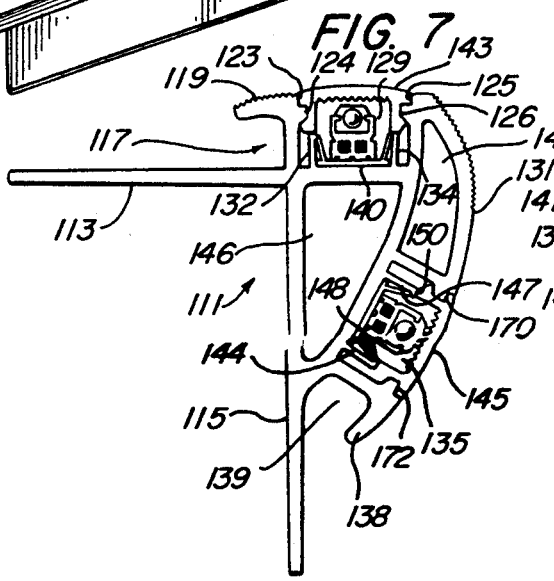
FIG. 7 is a cross-sectional view of one end of the lighting apparatus of FIG. 5.
Figure 8:
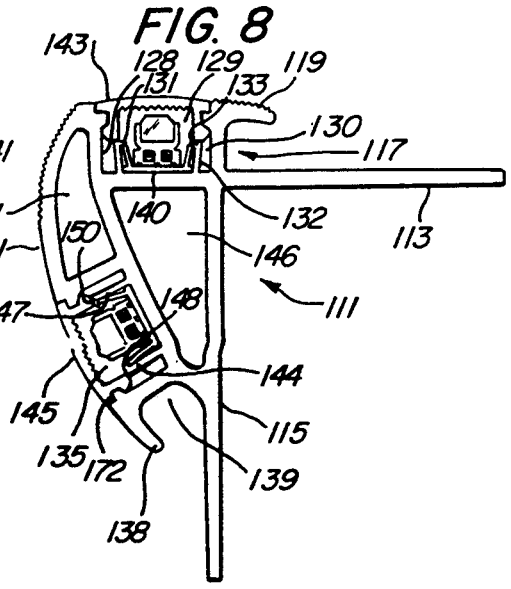
FIG. 8 is a cross-sectional view of the lighting apparatus of FIG. 5 showing the end opposite that shown in FIG. 7.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a particularly useful and readily-manufacturable step lighting apparatus.

FIGS. 1–4 illustrate a light fixture housing extrusion 11 according to a preferred embodiment of the invention. The extrusion 11 includes a horizontal step plate 13 and vertical riser plate 15, which intersect in a right angle. The extrusion 11 is preferably vinyl for durability, but may be extruded from other materials, such as polycarbonate. A lip 19 extends over the horizontal step plate 13 and is integrally-formed therewith. The lip 19 provides a gently curved extension defining a carpet insert slot 17.

Adjacent the lip 19 is a first channel 29. This first channel 29 includes respective channel walls 27, 28 in which are formed a first pair of generally oppositely-disposed grooves 23, 25 and a second pair of generally oppositely-disposed grooves 30, 32. These grooves 23, 25; 30, 32 define a first pair of oppositely-disposed tangs 24, 26 and a second pair of oppositely-disposed tangs 34, 36 extending from the respective walls 27, 28 of the channel 29. A first translucent plastic cover 43 is fitted into the channel 29 and is shaped in cross-section to snap-fittingly mate with the pairs of grooves 23, 25; 30, 32. This lens cover 43 may be referred to as a "tread lens cover." A light string including lamp carriages 61 is inserted in the channel 29 to illuminate the top edge of a step.

Beyond the first channel 29, the external surface of the housing extrusion 11 continues horizontally and is then curved vertically downward through 90 degrees, to form a rounded corner surface 31. A portion of the surface 31 is ribbed or serrated to create an antiskid surface. The area over which the serrations appears may, of course, be varied. A rectangular interior opening lies within the contour of corner surface 31 and includes a diagonal rib 41 for structural support.

A second, generally rectangular channel 35 is defined beneath the corner 31. The second channel 35 has first and second interior walls 34, 38 in which are formed oppositely-disposed grooves 36, 37. A second carpet insert slot 39 of generally rectangular cross-section is formed adjacent the generally rectangular channel 35. A second translucent plastic cover 45 is snap-fittingly mated with the grooves 36, 37. This lens cover 45 may be referred to as a "riser lens cover." A light string (not shown) is also optionally installed in channel 35 to illuminate the base of a step. A line perpendicular to the base of the second channel 35 parallels the vertical wall 15 such that light emanating from the channel through cover 45 is directed downwardly and thus is relatively muted to the viewer.

Light strings, including light fixtures 61, may be installed in either channel 29, 35, or both, as desired. In an embodiment where no light string is installed in the first channel 29, an opaque tread lens cover may be used to give the appearance of a continuous tread surface.

Figure 9:
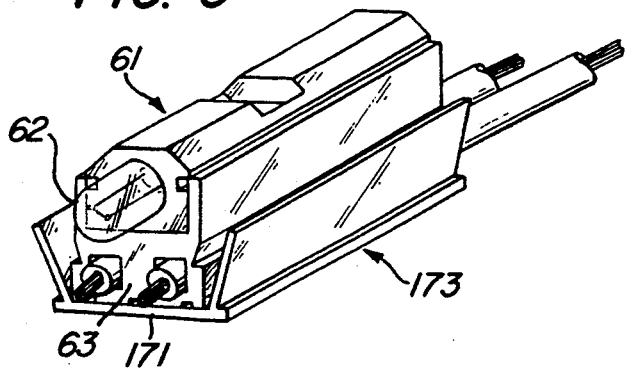
FIG. 9 is a perspective view of a spring clip fixture carriage used according to the preferred embodiment.

The preferred lighting fixture 61 is that disclosed in U.S. Pat. No. 5,045,981, incorporated by reference herein and shown in more detail in FIG. 9. Briefly, this light fixture employs a light bulb 62 inserted in a socket which is releasably secured to a carriage 63. The electrical contact to a pair of leads on the light bulb 62 is made by a pair of arcuate terminals fastened within the carriage 63. The terminals have one free end so that they may bend freely upon insertion of the socket within the carriage. The socket includes a depression configured to conform to the shape of the arcuate terminals, so that the terminals snap into the depression when the socket is inserted into the carriage 63. The leads extend across the depression to improve the electrical contact. The socket is further secured to the carriage 63 by a pair of grooves which mate to the carriage's guiding rails.

According to the preferred embodiment, the lamp carriage 63 is attached to the base 171 of a metal wedge clip carriage 173, e.g., by gluing. The wedge clip carriage 172 includes two wings 172, 174 attached to the respective edges of the base and extending outwardly therefrom. The wings 172, 174 are springably attached to the base such that they may bend in an arc 176 about the position shown in FIG. 10*a*.

Figure 10A:
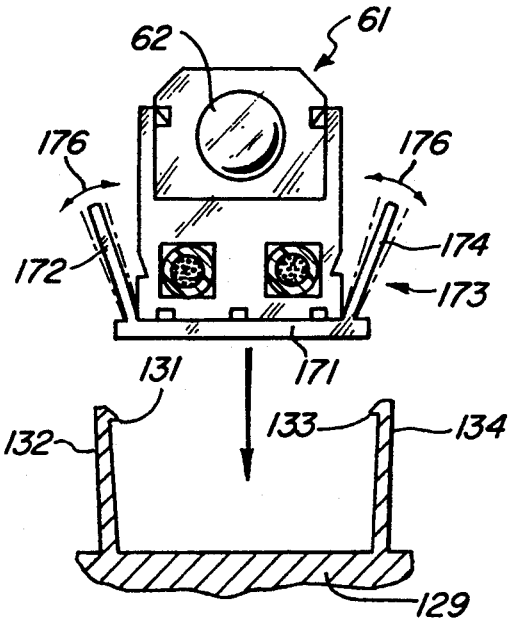
FIG. 10*a* is an exploded cross-sectional view of a spring clip carriage prior to insertion into the channel of lighting apparatus according to the preferred embodiment.
Figure 10B:
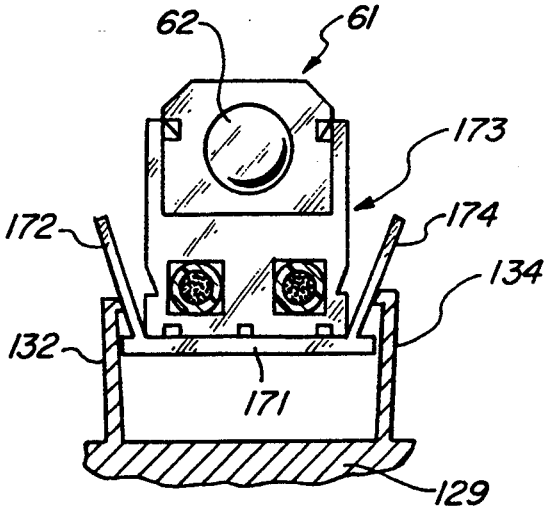
FIG. 10*b* is an exploded cross-sectional view of the spring clip lamp carriage of FIG. 10 at the initial stage of insertion into the channel.
Figure 10C:
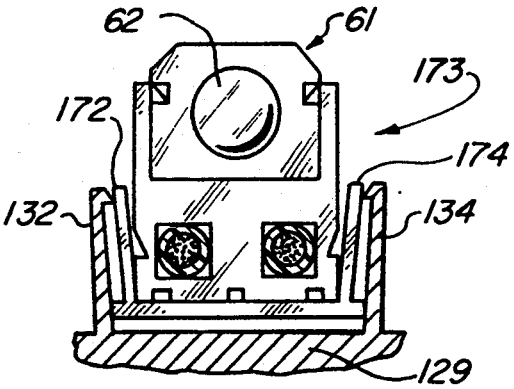
FIG. 10*c* is an exploded cross-sectional view of the spring clip lamp carriage at a second stage of insertion.
Figure 10D:
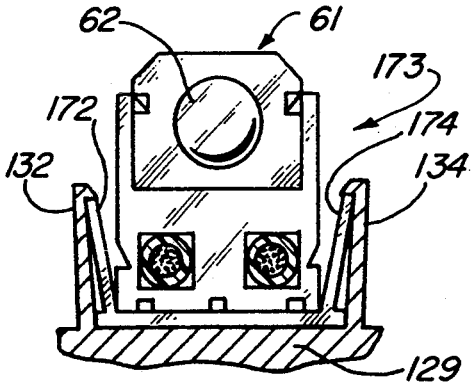
FIG. 10*d* is a cross-sectional view of the spring clip lamp carriage fully inserted into the channel.

FIGS. 10*a*–10*d* illustrate how the wedge clip carriage 173 is inserted into and retained by a cooperating channel such as 129. In FIG. 10a, the wedge clip carriage 173 is about to be inserted into the channel 129. In FIG. 10*b*, the wedge clip carriage 173 is initially being inserted into the channel 129, and the wings 172, 174 are being slightly forced inward against their bias towards the light fixture 61. In FIG. 10*c*, the wedge clip carriage 173 is almost completely inserted into the channel 129, and the wings 172, 174 have been forced inward by tangs 131, 133 located on a pair of relatively rigid interior channel walls 132, 134. FIG. 10*d* illustrates the wedge clip lamp carriage 173 completely inserted, in which position the wings 172, 174 have released outwardly against the walls 132, 134 and beneath the tangs 131, 133.

With respect to channel 129, it will be observed, for example, from FIG. 10*e*, that the tangs 131, 133 are raised above the base of the channel 129 to a height sufficient such that the base 171 of the wedge clip carriages 173 will not bottom out as the spring clip sides or wings 172, 174 are pinched in by the tangs 131, 133, thereby permitting the carriages 173 to be snapped into the channel 129.

FIGS. 5–8 illustrate a light fixture housing extrusion 111 according to a second preferred embodiment of the invention. The extrusion 111 again includes a horizontal step plate 113 and vertical riser plate 115, which intersect in a right angle. The top surface of the horizontal step plate 113 again underlies an integrally-formed lip 119. The lip 119 comprises a gently curved extension forming a carpet insert slot 117.

Adjacent the lip 119 is a first channel 129. Channel 129 includes channel walls 128, 130 in which is formed a pair of generally oppositely-disposed grooves 123, 125. The grooves 123, 125 define a first pair of oppositely-disposed tangs 124, 126 extending from the respective walls 128, 130 of the channel 129.

The floor 140 of the first channel 129 includes first and second recessed interior walls 132, 134 defining an interior channel within channel 129. Each interior wall 132, 134 terminates at its upper end in inwardly-directed tangs 131, 133. The use of separate interior walls 132, 134 permits the translucent cover 143 over the light channel 129 to be of any desired width, while still accommodating a fixture 61 of a standard width.

Beyond the first channel 129, the external surface of the housing extrusion 111 slopes outwardly, sharply downward, and then inward, forming a corner 131 of "ear-shaped" cross-section. A portion of the surface of the corner 131 is again ribbed or serrated to create an antiskid surface. The ear-shaped corner 131 includes first and second interior openings 141, 146 within its contour.

A second channel 135 is defined in the downwardly- and inwardly-sloping portion of corner 131. A line perpendicular to the planar floor of the second channel 135 forms a 60-degree angle with the vertical such that lighting in the channel provides a bold illumination of the step to a user which is visible from considerable distances. The interior structure of the second channel 135 is similar to that of the first channel 129 including a pair of grooves 170, 172 and interior walls 144, 147 carrying oppositely-disposed tangs 148, 150. A second carpet insert slot 139 of generally rectangular cross-section is formed by lip 138 extending below the second channel 135.

Figure 11:
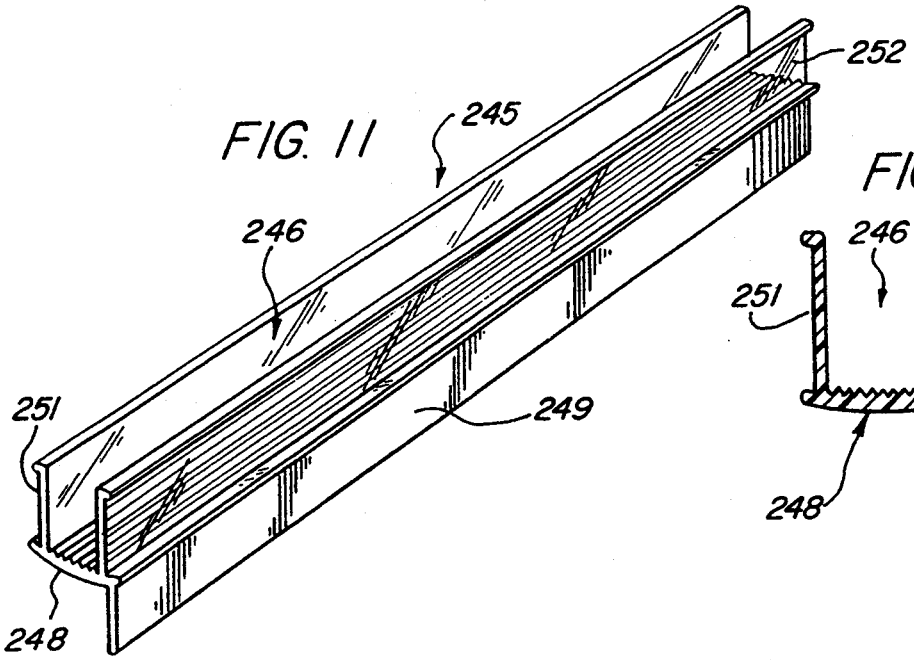
FIG. 11 is a side elevation of an improved riser lens cover.
Figure 12:
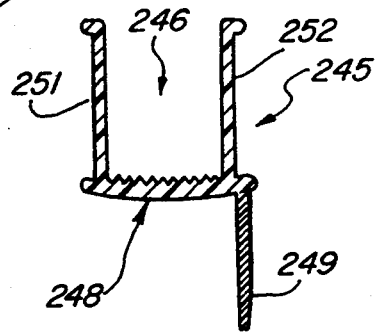
FIG. 12 is an end view of the riser lens cover of FIG. 11.

FIGS. 11 and 12 illustrate an improved riser plate lens cover 245. This lens cover 245 may be advantageously used to cover the second channel 35 in the embodiment of FIGS. 1–4.

The lens cover 245 includes an interior channel 246 of generally rectangular cross-section defined by first and second side walls 251, 252 and slightly arcuate top surface 248. Extending downward vertically from the top surface 248 is a generally rectangular, planar shield 249. The entire lens cover 245 is preferably a single vinyl extrusion with the side walls 251, 252 and top surface 248 being of a translucent material and the shield 249 being of an opaque black material. The shield 249 functions in a staircase which rises above eye level to prevent glare of individual light fixtures from reaching the eye of someone approaching or using the staircase.

Figure 13:
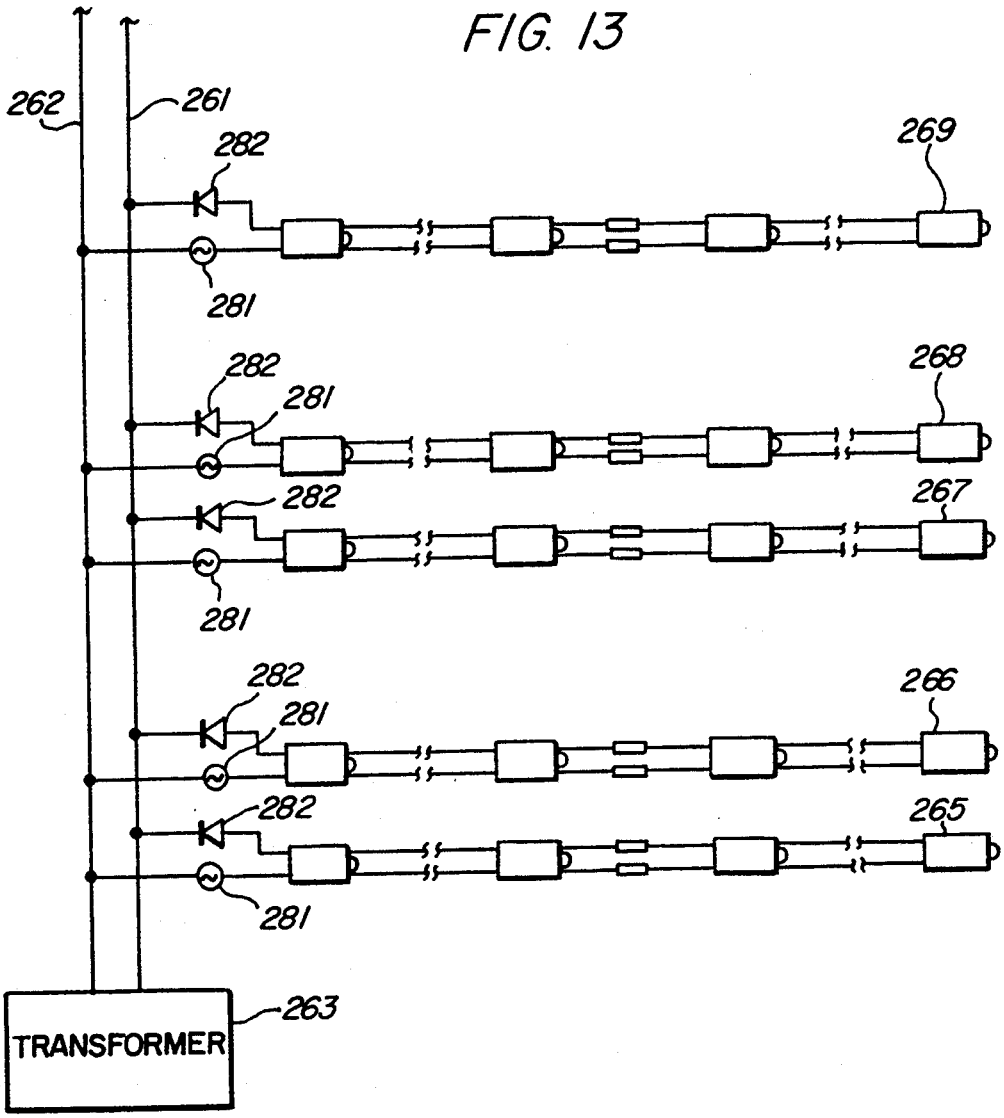
FIG. 13 is an electrical circuit diagram according to a preferred embodiment.

FIG. 13 discloses an improved electrical circuit particularly suitable for use with a staircase lighting system. As shown, main leads 261, 262 emanate from a transformer 263. Individual light strings 265, 266, 267, 268, 269 tap off the main leads 261, 262. Each individual string, e.g. 265, is installed in a respective channel, e.g. 29, of a light fixture housing extrusion, e.g. 11 (FIGS. 1–4). Assuming a light string is installed in each channel 29, 35 of a fixture according to FIGS. 1–4, there is a pair of strings for each step. Thus, strings 265, 266 illuminate one step, strings 267, 268 the next step, and so forth.

Each light string 265, 266 of FIG. 13 includes a fuse 281. The fuse 281 serves to prevent a short in one circuit, e.g. 265, from activating a circuit protector or fuse associated with transformer 263, which would disable the lighting of an entire stairway.

Alternating circuits 266, 268 also include a diode 282. The diode 282 causes a reduced amount of power (roughly one-half) to be supplied to the respective circuits 266, 268, thereby considerably dimming their illumination. Such dimming is particularly advantageous for the tread plate channels of extrusions used in movie theaters, where brighter lighting is distracting to the patrons.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved step lighting apparatus, comprising:

a light fixture housing extrusion having first and second channels formed therein, and a vertical riser plate intersecting with a horizontal step plate at a right angle, the horizontal step plate including a top surface having an integrally-formed lip forming a first carpet insert slot; and a means for removably securing a light fixture in at least one of the first and second channels.

2. The lighting apparatus of claim 1 wherein said means for removably securing a light fixture comprises:

a carriage means for mounting an individual light element and having first and second spring-biased wings; and means in said at least one channel for snap-fittingly receiving said wings and retaining said carriage means.

3. The lighting apparatus of claim 2 wherein said light element comprises a light socket removably attached to a carriage having a first rectangular base, said first base being attached to a second rectangular floor formed in said carriage means, said wings extending from respective sides of said floor so as to define a wedge-shaped cross-section therebetween.

4. The lighting apparatus of claim 1 wherein said first channel is formed adjacent the horizontal step plate, has first and second channel walls, and includes respective oppositely-disposed grooves in the upper portion of the first and second channel walls.

5. The lighting apparatus of claim 4 further including:

a first pair of oppositely-disposed tangs, one of said first pair of tangs extending from a respective one of the first pair of grooves;

a second pair of oppositely-disposed grooves, one of said second pair of grooves being located in the middle portion of a respective one of said first and second channel walls; and a second pair of oppositely-disposed tangs, one of said second pair of tangs extending from a respective one of the second pair of oppositely-disposed grooves.

6. The lighting apparatus of claim 5 including a rounded, 90-degree corner adjacent said first channel.

7. The lighting apparatus of claim 6 wherein said second channel is disposed beneath said rounded corner.

8. The lighting apparatus of claim 8 wherein said second channel has first and second walls and includes a third pair of oppositely-disposed grooves, one of said third pair of grooves being located in the upper portion of a respective one of the first and second walls of the second channel.

9. The lighting apparatus of claim 8 further including a second carpet insert slot formed between said vertical riser plate and said second channel.

10. The lighting apparatus of claim 5 wherein said second channel has first and second parallel walls and a line parallel to said walls intersects said vertical riser plate in a 60-degree angle.

11. The lighting apparatus of claim 3 wherein said means for snap fittingly receiving said wings includes first and second interior recessed walls extending from the floor of at least one of said first and second channels.

12. The lighting apparatus of claim 1 wherein each of said interior recessed walls includes a tang at the top thereof, the tangs on the respective recessed walls being oppositely disposed.

13. The lighting apparatus of claim 1 wherein said second channel comprises a riser plate channel and further includes a light-transmitting riser plate lens cover for said channel, said lens cover having an opaque shield extending vertically downward therefrom.

14. The lighting apparatus of claim 1 wherein said first channel comprises a tread plate channel and further includes a light string circuit in one of said first and second channels, said circuit including a diode for forming the light output of said circuit.

15. An improved step lighting apparatus, comprising:

a horizontal step plate:

a lip extending over said horizontal step plate and integrally formed therewith to define a first carpet insert slot;

a vertical riser plate intersecting at a right angle with the horizontal step plate;

the top surface of the vertical riser plate terminating in an integrally-formed lip to define a second carpet insert slot;

a first channel in the horizontal step plate adjacent to the first carpet insert slot and having first and second walls;

a first pair of oppositely disposed grooves, one of the first pair of grooves being disposed in the upper portion of a respective portion of the first and second walls of said first channel;

a second pair of oppositely disposed grooves, one of the second pair of grooves being disposed in the middle portion of a respective one of the first and second walls of said first channel, and beneath a respective one of said first pair of grooves;

a first pair of oppositely-disposed tangs, one of the first pair of tangs extending from a respective one of the first pair of grooves;

a second pair of oppositely-disposed tangs, one of the second pair of tangs extending from a respective one of the second pair of grooves;

a rounded corner with a ribbed surface, formed by the horizontal step plate continuing horizontally and then curving vertically downward;

a second channel located beneath the rounded corner, adjacent to the second carpet insert slot;

a third pair of grooves oppositely disposed in the upper portion of the second channel; and a wedge clip lamp carriage for securing a light fixture within at least one of the first and second channels, said lamp carriage including a base and oppositely-disposed first and second spring-biased wings connected to the sides of the base.

16. An improved step lighting apparatus, comprising:

a horizontal step plate;

a lip extending over said horizontal step plate and integrally formed therewith to define a first carpet insert slot;

a vertical riser plate, intersecting at a right angle with the horizontal step plate:

the top surface of the vertical riser plate terminating in an integrally formed lip to define a second carpet insert slot:

a first channel in the horizontal step plate, adjacent to the first carpet insert slot, said first channel having first and second walls and a floor;

a first pair of oppositely-disposed grooves, one of said first pair of grooves being formed in the upper portion of a respective one of the first and second walls of the first channel;

a first pair of oppositely-disposed tangs, one of the first pair of tangs extending from a respective one of the first and second walls of said first channel;

a first pair of interior recessed walls extending from the floor of the first channel;

a second pair of oppositely-disposed tangs, one of the second pair of tangs extending from the top of a respective one of the first pair of interior recessed walls;

an elongated corner, with a ribbed surface, formed by the top surface of the horizontal step plate continuing beyond the first channel and turning downward and then inward toward the vertical riser plate;

a second channel at the lower end of the elongated corner adjacent to the second carpet insert slot having first and second walls and a floor;

a second pair of oppositely-disposed grooves, one of the second pair of grooves being formed in the upper portion of a respective one of the first and second walls of said second channel;

a third pair of oppositely-disposed tangs, one of said third pair of tangs extending from the upper portion of a respective one of the first and second walls of the second channel;

a second pair of interior recessed walls extending from the floor of the second channel;

a wedge pair of oppositely-disposed tangs, one of said fourth pair of tangs extending from a respective one of the second pair of interior recessed walls; and a wedge clip lamp carriage for securing a light fixture within at least one of the channels, said lamp carriage including a base and oppositely-disposed first and second spring-biased wings connected to the sides of the base.

17. An improved step lighting apparatus, comprising:

a light fixture housing extrusion having first and second channels formed therein, said first channel comprising a tread plate channel; and a means for removably securing a light fixture in at least one of the first and second channels, said light fixture comprising a part of a light string circuit, said circuit including a diode for dimming the light output of said circuit.

18. The lighting apparatus of claim 17 wherein said means for removably securing a light fixture comprises:

a carriage means for mounting an individual light element and having first and second spring-biased wings; and means in said at least one channel for snap-fittingly receiving said wings and retaining said carriage means.

19. An improved step lighting apparatus, comprising:

a light fixture housing extrusion having first and second channels formed therein: and a means for removably securing a light fixture in at least one of the first and second channels said light fixture comprising a light socket removably attached to a carriage element, the carriage element having a rectangular base, said means for removably securing the light fixture comprising:

a wedge clamp carriage means for mounting said carriage element, said wedge clamp carriage means having a rectangular floor for attachment to the base of said carriage element and first and second rectangular wings, the wings being springably attached to a respective side of the floor of the wedge clamp carriage means so as to define a wedge-shaped cross-section between said wings; and means in said at least one channel for snap-fittingly receiving said wings and retaining said wedge clamp carriage means.

* * * * *